US006281763B1

(12) United States Patent
Ishikawa et al.

(10) Patent No.: US 6,281,763 B1
(45) Date of Patent: Aug. 28, 2001

(54) DIELECTRIC RESONATOR, DIELECTRIC FILTER, DIELECTRIC DUPLEXER, AND METHOD FOR MANUFACTURING DIELECTRIC RESONATOR

(75) Inventors: Yohei Ishikawa, Kyoto; Seiji Hidaka, Nagaokakyo; Norifumi Matsui, Kyoto; Tomoyuki Ise, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/355,441

(22) PCT Filed: Jan. 20, 1998

(86) PCT No.: PCT/JP98/00181

§ 371 Date: Jul. 28, 1999

§ 102(e) Date: Jul. 28, 1999

(87) PCT Pub. No.: WO98/33229

PCT Pub. Date: Jul. 30, 1998

(30) Foreign Application Priority Data

Jan. 28, 1997 (JP) ..... 9-14048

(51) Int. Cl.[7] ..... H01P 7/10; H01P 7/00; H01P 1/20

(52) U.S. Cl. ..... 333/134; 333/219; 333/202; 333/219.1

(58) Field of Search ..... 333/219, 202, 333/208, 219.1, 134; 29/846, 592.1, 595, 830, 610.1, 620

(56) References Cited

U.S. PATENT DOCUMENTS

| | | | | |
|---|---|---|---|---|
| 5,770,988 | * | 6/1998 | Goto et al. | 333/236 |
| 5,920,243 | * | 7/1999 | Ishikawa et al. | 333/204 |
| 6,052,041 | * | 4/2000 | Ishikawa et al. | 333/202 |

FOREIGN PATENT DOCUMENTS

| | | |
|---|---|---|
| 8-242109 | 9/1996 | (JP) . |
| 8-265014 | 10/1996 | (JP) . |
| 8-293705 | 11/1996 | (JP) . |
| WO96 42118 | 12/1996 | (WO) . |

* cited by examiner

*Primary Examiner*—Robert Pascal
*Assistant Examiner*—Kimberly E Glenn
(74) *Attorney, Agent, or Firm*—Ostrolenk, Faber, Gerb & Soffen, LLP

(57) ABSTRACT

A dielectric resonator comprises electrodes formed on both the main surfaces of a dielectric substrate and a thin film multi-layer electrode of thin film conductor layers and thin film dielectric layers having fixed thickness alternately laminated which constitutes at least one of the electrodes, and is characterized in that by giving abrasive treatment or etching treatment to the external portion of the dielectric substrate and the external portion of the electrodes formed on both the main surfaces of the dielectric substrate the end portions of the electrode is made in an electrically open-circuited condition. In this way, a dielectric resonator making effective use of the characteristic of low loss of the thin film multi-layer electrode is presented.

12 Claims, 5 Drawing Sheets

DIELECTRIC RESONATOR, DIELECTRIC FILTER, DIELECTRIC DUPLEXER, AND METHOD FOR MANUFACTURING DIELECTRIC RESONATOR

TECHNICAL FIELD

This invention relates to a dielectric resonator, dielectric filter, dielectric duplexer and manufacturing method of such. More particularly, this invention relates to a dielectric resonator, dielectric filter, dielectric duplexer, etc. to be used in the microwave and milliwave frequency bands and utilized in the field of mobile communication.

BACKGROUND ART

In recent years, with the rapid development of mobile communication systems the demand for small-sized and high performance mobile communication equipment is going up more and more. In order to satisfy such a demand, the applicant of the application concerned proposed earlier a thin film multi-layer electrode of thin film conductor layers and thin film dielectric layers having fixed thickness which are alternately laminated, to realize a low-loss electrode.

For example, in a circular TM mode resonator, a thin film multi-layer electrode formed in a method to be described hereinafter has been used.

That is, as shown in FIG. 6, the circular TM mode resonator 53 with open-ended side comprises a thin film multi-layer electrode 52 of layers of thin film conductor and dielectric substance alternately formed by sputtering and using a metal mask on the main surface of a circular dielectric substrate 51 both the main surfaces of which have been ground to be flat. Further, although not illustrated in FIG. 6, a thin film multi-layer electrode is formed on the lower side of the circular dielectric substrate 51 as on the upper side. FIG. 7 is an expanded sectional view in the vicinity of the external portion of the resonator 53. A thin film multi-layer electrode 52 is formed in such a way that as shown in FIG. 7, a couple of thin film conductor layers 54 and thin film dielectric layers 55 are alternately given on the dielectric substrate 51. In the vicinity of the external portion (the righthand side of FIG. 7), the thin film conductor layers 54 and thin film dielectric layers 55 are in a tapered shape. This is because sputtered particles migrate into a very little gap between the metal mask and dielectric substrate 51 when the thin films are formed by sputtering. Further, in the external portion 56 of the dielectric substrate 51 the thin film multi-layer electrode 52 is not formed because the external portion is pressed and covered by a metal mask fixed to the dielectric substrate in the formation of thin films by sputtering. Line X—X in FIG. 7 shows a masking line defined by the metal mask.

However, the above-mentioned conventional circular TM mode resonator 53 has had a problem to be described hereinafter.

First, regarding the thin film multi-layer electrode 52 to be formed on both the main surfaces of the dielectric substrate 51, it is difficult to form the thin film multi-layer electrode formed on one main surface and the thin film multi-layer electrode formed on the other main surface so that both of the electrodes lie exactly one on top of another, on opposite surfaces of the dielectric substrate 51. That is, there are cases in which the electrodes are displaced from each other.

Further, in the conventional circular TM mode resonator 53, because the external portion 56 of the dielectric substrate 51 remains as an excessive dielectric material, the stray capacitance between the thin film multi-layer electrodes formed on both the main surfaces has become large.

More, although the thin film conductor layers 54 should be electrically insulated from each other, there is a chance of an electrical short-circuit at the tapered part of the external portion of the thin film multi-layer electrode 52.

The three things pointed out in the above have caused the conventional thin film multi-layer electrode to be deviated from a boundary condition for its original low-loss operation. For example, in an open-ended circular TM mode resonator 53, the conductor loss inside the resonator is increased and no-load Q of the resonator is degraded.

Further, although the resonance frequency of the open-ended circular TM mode resonator 53 is determined by the diameter of the circular thin film multi-layer electrode 52, when the thin film multi-layer electrode 52 is formed by using a metal mask, as described above, and because the diameter of the thin film multi-layer electrode becomes larger than the diameter of the metal mask, for example, due to sputtered particles migrated between the metal mask and the dielectric substrate 51, it is difficult to form an electrode 52 having a desired diameter.

SUMMARY OF THE INVENTION

Accordingly, an object of the present invention is to solve the above-mentioned technical problems and to present a dielectric resonator to be able to make effective use of the characteristic of low loss shown by a thin film multi-layer electrode.

In order to attain the above-mentioned object, a dielectric resonator according to a first aspect of the present invention comprises electrodes formed on both the main surfaces of a dielectric substrate, and has for at least one of the electrodes a thin film multi-layer electrode of thin film conductor layers and thin film dielectric layers having fixed thickness which are alternately laminated, and is characterized in that at the end portion of the thin film conductor layers the layers are electrically open from each other, and in that each of the end portions of the dielectric substrate, the thin film conductor layers, and the thin film dielectric layers is aligned nearly with the same surface.

Further, a dielectric resonator according to a second aspect of the present invention comprises electrodes formed on both of the main surfaces of a dielectric substrate, and has for at least one of the electrodes a thin film multi-layer electrode of thin film conductor layers and thin film dielectric layers having fixed thickness which are alternately laminated, and is characterized in that abrasive or etching treatment is given to the external portion of the dielectric substrate and the external portion of the electrodes formed on both the main surfaces of the dielectric substrate in order to place the end portion of the electrodes is in an electrically open-circuited condition.

In this way, a dielectric resonator under a uniform boundary condition is able to be obtained.

Further, a dielectric resonator according to a third aspect of the present invention is characterized in that a dielectric substrate constituting a dielectric resonator according to the first or second aspect of the present invention is made in a cylindrical form.

In this way, it is made easier to give dimensionally high-precision abrasive treatment to dielectric resonators.

In addition, a dielectric resonator according to a fourth aspect of the present invention is characterized in that the thickness of each film of the thin film conductor layers and the thin film dielectric layers of the thin film multi-layer electrode formed on at least one main surface of the dielectric substrate of a dielectric resonator according to the first, second or third aspect of the present invention is nearly uniform all over the entire surface of the thin film multi-layer electrode.

In this way, a dielectric resonator under a more uniform boundary condition than a dielectric resonator according to the first three aspects of the present invention is able to be obtained.

And a dielectric filter according to a fifth aspect of the present invention is characterized in that input-output connections are provided in a dielectric resonator according to one of the first through fourth aspects of the present invention.

In this way, a dielectric filter making the best use of the strong points of the dielectric resonator of the first through fourth aspects of the present invention is able to be obtained.

Further, a dielectric duplexer according to a sixth aspect of the present invention comprises a first group of resonators made up of at least one dielectric resonator as in one of the first through fourth aspects of the present invention, a second group of resonators made up of at least one dielectric resonator as in one of the first through fourth aspects of the present invention, a first input-output connection and a second input-output connection coupled to the first group of resonators, and a third input-output connection and a fourth input-output connection coupled to the second group of resonators. More, according to a seventh aspect of the invention, it is possible to share one of the input-output connections coupled to the first group of resonators and one of the input-output connections coupled to the second group of resonators.

In this way, a dielectric duplexer making the best use of the strong points of the dielectric resonator of the first through fourth aspects of the present invention is able to be obtained.

Furthermore, the method of making a dielectric resonator according to an eighth aspect of the present invention comprises the steps of: preparing a dielectric substrate both the main surfaces of which have been ground to be flat; forming on both the main surfaces of the dielectric substrate a thin film multi-layer electrode of thin film conductor layers and thin film dielectric layers having fixed thickness which are alternately laminated; and putting the end portion of the electrodes in an electrically open-circuited condition by giving abrasive or etching treatment to the external portion of the dielectric substrate and the external portion of the electrodes formed on both the main surfaces of the dielectric substrate.

In this way, a dielectric resonator with the end portion of the electrodes in an electrically open-circuited condition is able to be obtained.

BEST MODE FOR CARRYING OUT THE INVENTION

Hereinafter, embodiments of the present invention are explained in detail with reference to the accompanying drawings.

Figure 1:
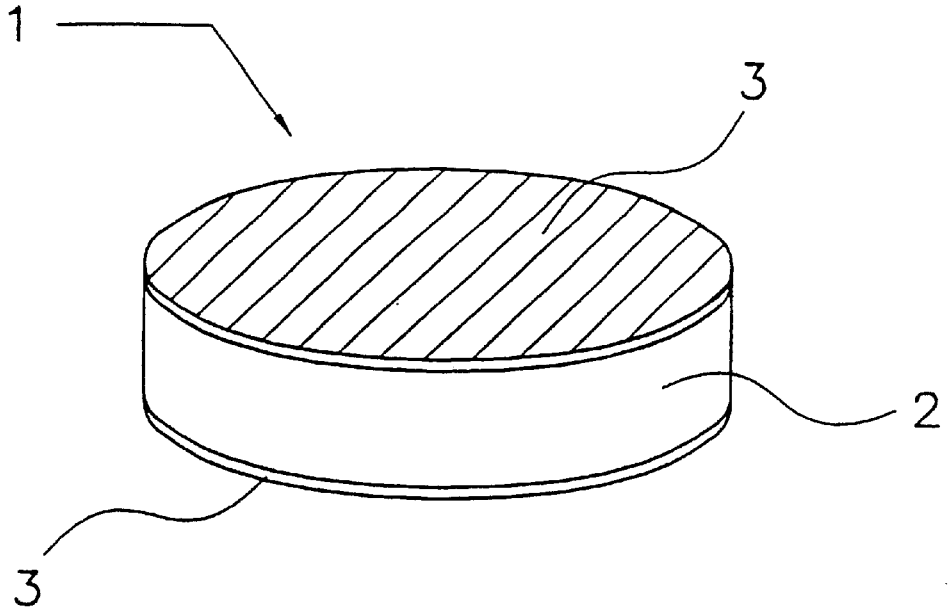
FIG. 1 is a perspective view showing a dielectric resonator of a first embodiment of the present invention.
Figure 2:
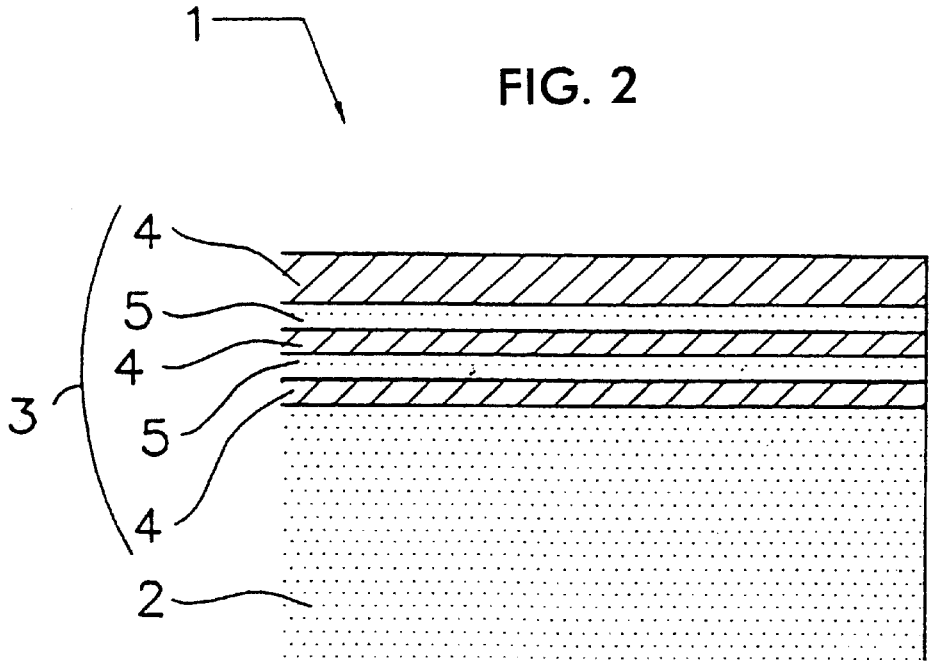
FIG. 2 is an expanded sectional view showing the external portion of the electrode of a dielectric resonator of a first embodiment of the present invention.

A circular TM mode resonator with open-ended side is made up of thin film multi-layer electrodes 3 formed on both the main surfaces of a dielectric substrate 2 in a cylindrical form as shown in FIG. 1. Further, as shown in an expanded sectional view of FIG. 2, the external portion of the thin film multi-layer electrode 3 is aligned with the external portion of the dielectric substrate 2 so as to share the same surface, and are made to be under an electrically open condition. Hereinafter, the manufacturing method of a circular TM mode resonator of the present embodiment is explained.

Figure 6:
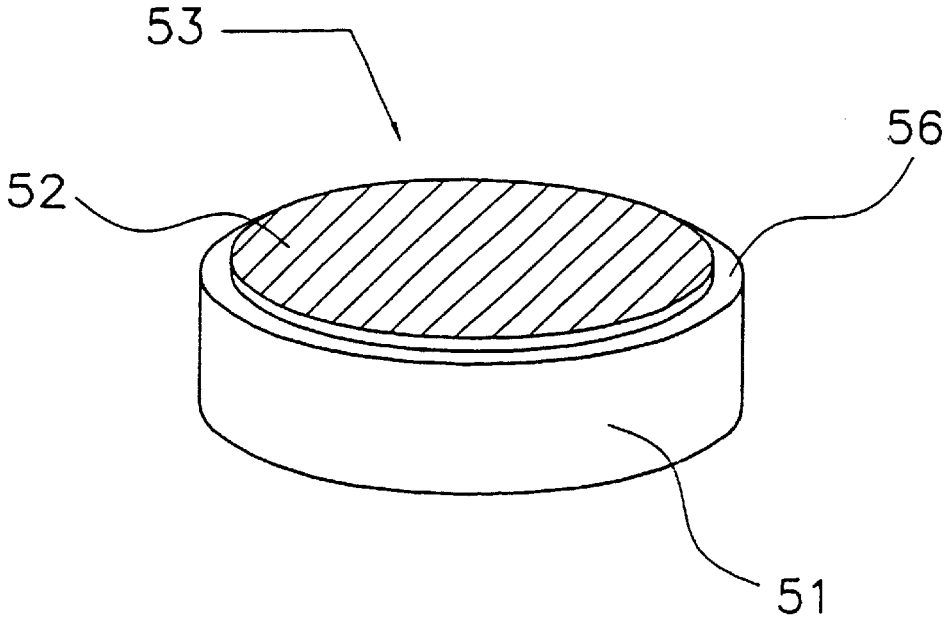
FIG. 6 is a perspective view showing a conventional circular TM mode resonator.
Figure 7:
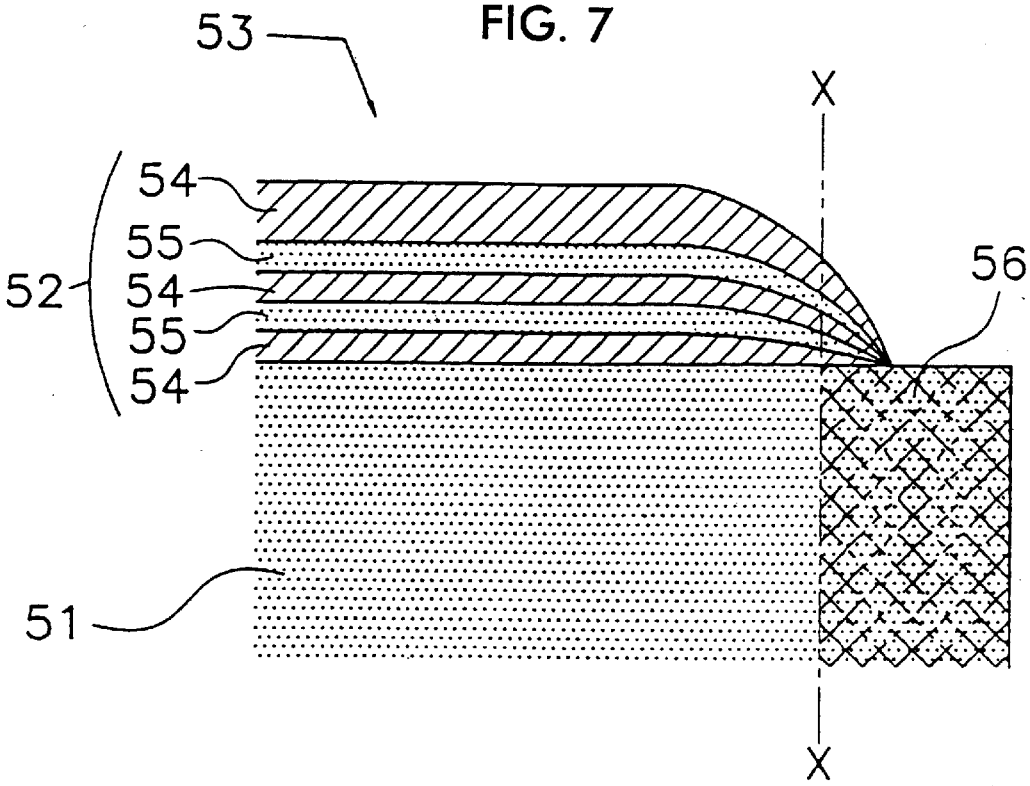
FIG. 7 is an expanded perspective view showing the external portion of the electrode of a conventional circular TM mode resonator.

First, a dielectric substrate 2 of a cylindrical form both the main surfaces of which have been ground to be flat is prepared, and by means of making a sputtered film on the main surface of the dielectric substrate 2 using a metal mask thin film conductor layers 4 and thin film dielectric layers 5 having fixed thickness are alternately laminated to form a thin film multi-layer electrode 3. When a sputtered film is made, both the films on the main surfaces may be made at a time or each of the films may be made separately. In the case of the present embodiment, the thickness of each of thin film conductor layers 4 and thin film dielectric layers 5 is made about 0.3 $\mu$m, but this figure may be changed at will in accordance with the application of electrodes. More, the circular TM mode resonator at this stage is the same as the conventional example shown in FIGS. 6 and 7.

Figure 3:
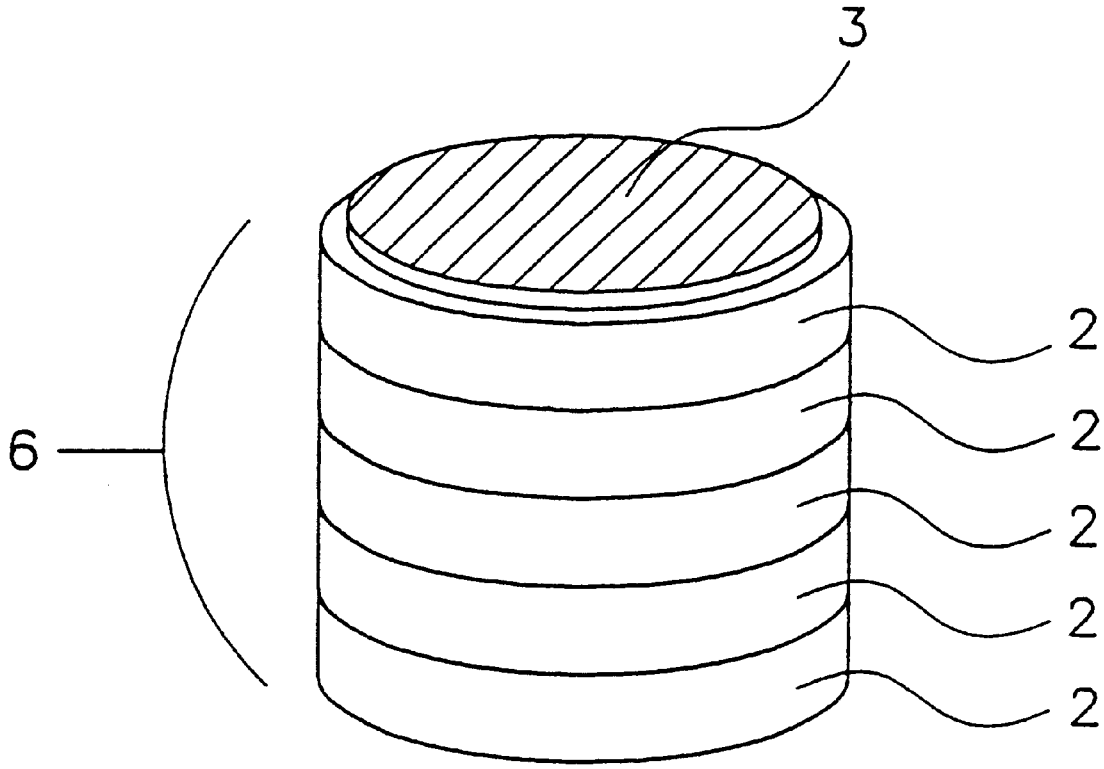
FIG. 3 is a perspective view showing a laminated body 6 to be formed in the manufacturing processes of a dielectric resonator of a first embodiment of the present invention.

Further, the thin film multi-layer electrodes 2 have been formed on both the main surfaces of the dielectric substrate 2, as shown in FIG. 3, a few dielectric substrates 2 as a unit are put one upon another and fixed using wax, etc. to form a laminated body 6. More, in FIG. 3, although only the thin film multi-layer electrode 3 located on the uppermost surface 3 of the laminated body 6 is illustrated, on both the main surfaces of each of dielectric substrates 2 constituting the laminated body 6 thin film multi-layer electrodes are formed. The formation of a laminated body 6 by putting dielectric substrates 2 one upon another is to realize effective mass production of circular TM mode resonators in the process of abrasive treatment.

Then, abrasive treatment is given to the external portion of the laminated body 6 in FIG. 3, and the dielectric substrate 2 and thin film multi-layer electrodes 3 are ground. At that time, they are ground so as to remove the tapered external portion of the thin film multi-layer electrode 3 and the external portion 56 of the dielectric substrates 2 which is extended beyond the external portion of the thin film multi-layer electrodes 3. In this way, by removing the tapered portion of the thin film multi-layer electrodes 3, it is possible to secure an electrically open condition of the external portion of the electrodes and to make uniform the thickness of thin film conductor layers 4 and thin film dielectric layers 5 constituting the thin film multi-layer electrodes 3. Further, because the resonance frequency of a circular TM mode resonator 1 is determined by the diameter of the circular thin film multi-layer electrode 3, the electrode 3 is ground to the diameter of the circular electrode 3 which gives a desired resonance frequency when abrasive treatment is given. Thus, the method of deciding the diameter of the circular electrode 3 by abrasive treatment is able to form an electrode having a desired diameter of much greater precision than the conventional method of deciding the diameter of an electrode, that is, the method of deciding the diameter only by a metal mask.

And lastly, at the stage when the above abrasive treatment has been finished, heat treatment is given to the dielectric substrate laminated body 6 to remove wax and the separate circular TM mode resonator 1 can be obtained.

Through the above processes, the circular TM mode resonator 1 in FIG. 1 is formed.

More, in the above embodiment, a resonator with thin film multi-layer electrode 3 on both the main surfaces is illustrated. However, when a thin film multi-layer electrode is formed on at least one main surface of a resonator, the resonator shows the effect of the present invention, even if an ordinary electrode is formed on the other main surface by a method such as silver baking, etc.

Figure 4:
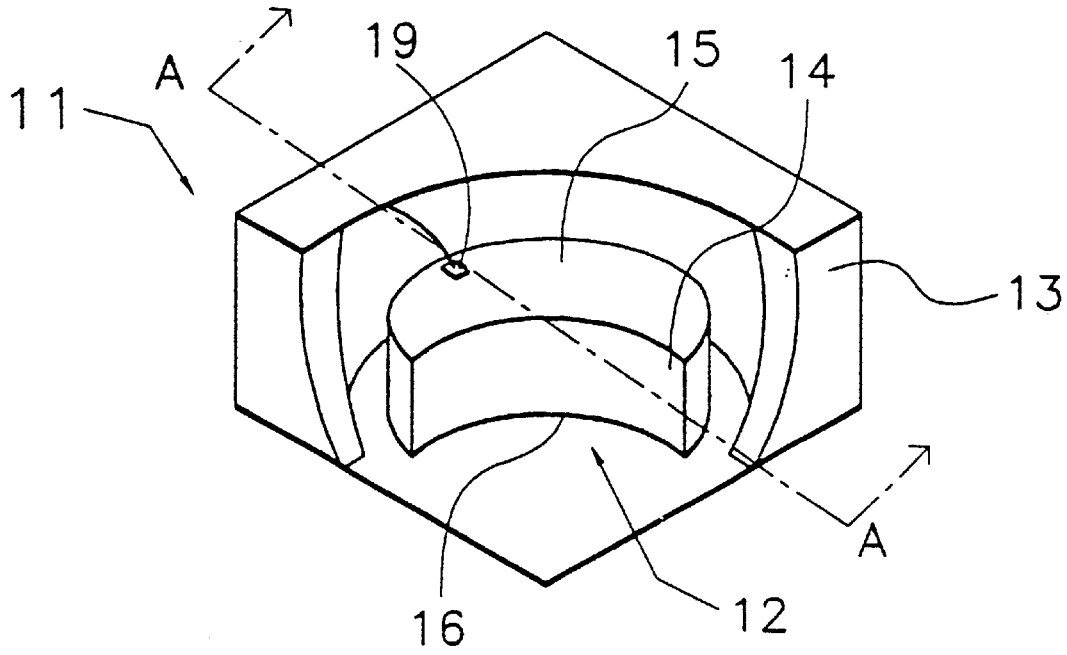
FIG. 4 is a partially cutaway perspective view showing a dielectric filter of a second embodiment of the present invention.
Figure 5:
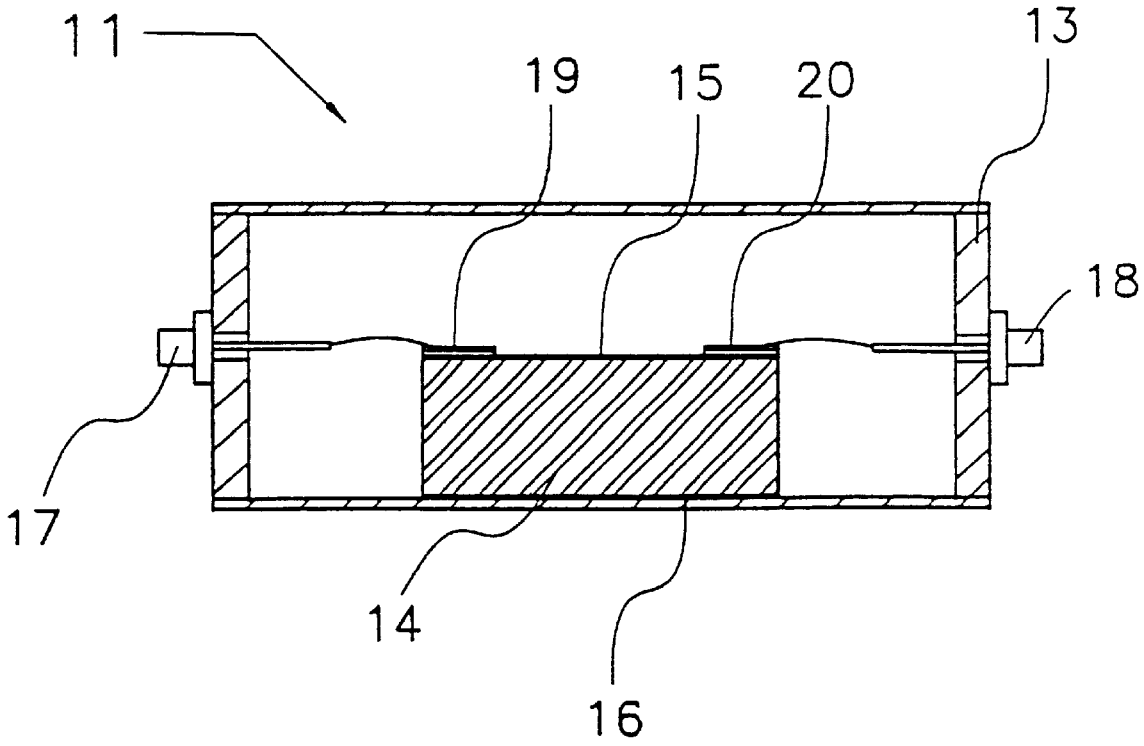
FIG. 5 is a sectional view taken on line A—A of FIG. 4.

As a second embodiment of the present invention, a dielectric filter 11 using a circular TM mode resonator 12 of open type is given as shown in FIGS. 4 and 5. FIG. 4 is a partially cutaway perspective view showing a dielectric filter of the present embodiment, and FIG. 5 is a sectional view taken on line A—A of FIG. 4. Regarding a circular TM mode resonator 12 to be used in the dielectric filter 11, the external portion of the thin film multi-layer electrodes formed on both the main surfaces is under an electrically open-ended condition through abrasive treatment. Hereinafter, the construction of the dielectric filter 11 of the present embodiment is explained.

First of all, as shown in FIG. 4, the dielectric filter 11 is composed of a circular TM mode resonator 12 arranged inside a metal shielding cavity 13.

The circular TM mode resonator 12 is made up of a dielectric substrate 14 of a cylindrical form and on both the main surfaces facing each other thin film multi-layer electrodes 15, 16 are formed. One electrode 16 of the resonator 12 is arranged so as to make contact with the inside bottom surface of the shielding cavity 13, and electrically connected and fixed by soldering, etc. The other electrode 15 is made to face the ceiling inside surface of the shielding cavity 13 with a fixed spacing therebetween.

Further, as shown in FIG. 5, on the side wall of the shielding cavity 13 external input-output coaxial connectors 17, 18 are set. The central electrodes of the coaxial connectors 17, 18 are electrically connected to the electrode sheets 19, 20, for example, by wiring.

The electrode sheets 19, 20 are an electrode film formed on the upper surface of an insulating material made up of a sheet-like resin, etc., and on the lower surface of the insulating material there is no electrode film formed. Further, the electrode sheets 19, 20 are arranged on the thin film multi-layer electrode 15 formed on the upper surface of the resonator 12, and the lower surface with no electrode film formed is stuck so as to make contact with the thin film multi-layer electrode 15.

The dielectric filter 11 constructed as above functions as in the following.

First, when a high-frequency signal is input to one coaxial connector 17, capacitance is generated because of an insulating material existing between the electrode film on the upper surface of the electrode sheet 19 connected to the central electrode of the coaxial connector 17 and the thin film multi-layer electrode 15 formed on the resonator 12. Through this capacitance the central electrode of the coaxial connector 17 is coupled to the resonator 12. And this coupling causes the resonator 12 to resonate, and through the capacitance of the electrode sheet 20 the signal is output from the other coaxial connector 18 connected to the electrode film on the upper surface of the electrode sheet 20.

Because of the above construction, when compared with the dielectric filter using a conventional circular TM mode resonator to which abrasive treatment is not given, a dielectric filter showing an excellent resonance frequency characteristic is able to be obtained.

Figure 8:
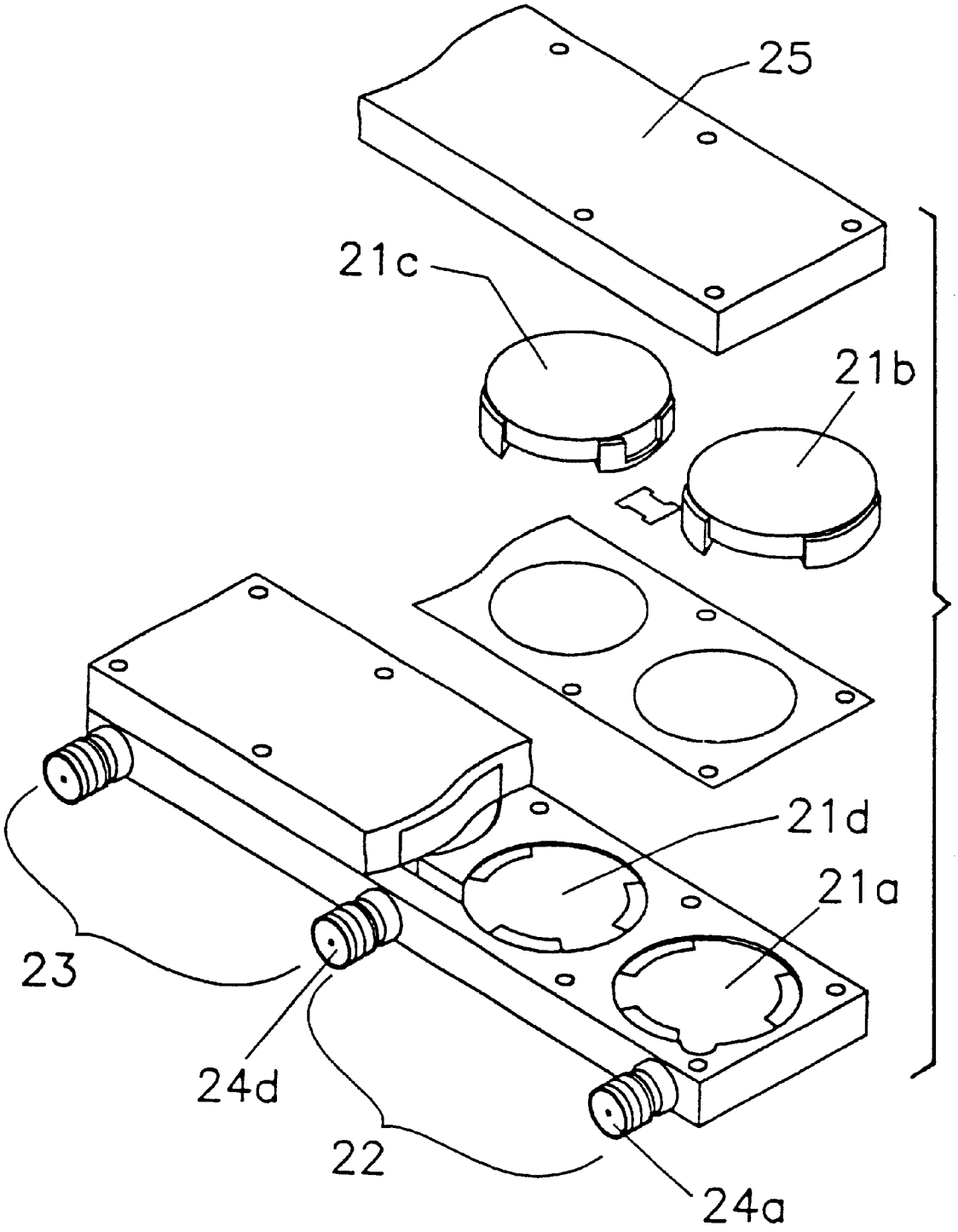
FIG. 8 is a partially cutaway perspective view showing a dielectric duplexer of a third embodiment of the present invention.

Next, a third embodiment is explained with reference to FIG. 8. FIG. 8 is a partially cutaway perspective view showing a dielectric duplexer 21, and the duplexer is composed of a first dielectric filter 22 having a first frequency bandwidth and a second dielectric filter 23 having a second frequency bandwidth.

The first dielectric filter 22 is, generally, made up of four dielectric resonators 22*a* through 22*d*, coaxial connectors 24*a*, 24*d*, and a shielding cavity 25 having concave portions to accept each of the dielectric resonators. The coaxial connector 24*a* is coupled to the dielectric resonator 22*a* through, for example, a matching capacitor, etc. which are not illustrated, the dielectric resonator 22*a* to the dielectric resonator 22*b*, the dielectric resonator 22*b* to the dielectric resonator 22*c*, and the dielectric resonator 22*c* to the dielectric resonator 22*d* respectively. And the dielectric resonator 22*d* is coupled to the coaxial connector 24*d* through, for example, a matching capacitor, etc. not illustrated. As explained above, the dielectric filter 22 made up of the four stages of dielectric resonators is constructed. More, as the second dielectric filter 23 is constructed in the same way, its explanation is omitted. Further, the coaxial connector 24*d* to be used in the second dielectric filter 23 and the coaxial connector used in the dielectric filter 23 is shared.

The dielectric duplexer 21 thus constructed is able to be used as a shared antenna for transmission and reception in such a way that, for example, the first frequency bandwidth is used as a reception frequency bandwidth and the second frequency bandwidth is used as a transmission frequency bandwidth. Further, it is also possible to use all the dielectric filters as a transmission filter or as a reception filter.

This dielectric dulpexer 21 is made to have an excellent resonance frequency characteristic compared with that of a dielectric duplexer using a conventional circular TM mode resonator to which abrasive treatment is not given.

As explained above, the resonators according to the present invention show various effects as in the following.

First, after the thin film multi-layer electrodes have been formed on both the main surfaces of the dielectric substrate, abrasive treatment or etching treatment is given to remove the external portion of the dielectric substrate including the tapered external portion of the electrode. And as a natural consequence the electrodes formed on both the main surfaces lie one on top of another when the dielectric substrate is seen through.

Further, as the excessive external portion of the dielectric substrate beyond the external portion of the electrode is ground to remove by abrasive treatment, etching, etc., stray capacitance produced around the external portion of the electrode is able to be suppressed to the minimum.

More, as the external tapered portion of the thin film multi-layer electrode is ground to remove by abrasive treatment, etching treatment, etc. and an electrical open-ended condition of the external portion of the electrode is secured, a fear of electrical short circuit between electrode films constituting the thin film multi-layer electrode is dismissed.

Because of the three points described above, the boundary condition of the thin film multi-layer electrodes formed on both the main surfaces of the dielectric substrate is made uniform and the characteristic of low loss which multi-layer electrodes have originally had is able to be fully utilized. As a result, the characteristic of the dielectric resonators is able to be improved.

Further, the process of abrasive treatment is, as described above, not only for making the boundary condition uniform, but also for adjusting the resonance frequency of the resonators. And, further, because of this method, it is possible to prevent a harmful influence which attended when an adjustment is carried out using a metal mask, in a concrete way, the ill effect that sputtered particles migrate to a space between the metal mask and dielectric substrate and an electrode having a diameter different from that of the mask is formed, and to adjust the frequency more accurately.

Further, the construction of dielectric filters and dielectric duplexers using these dielectric resonators makes available the dielectric filters and dielectric duplexers of low loss and excellent characteristics.

INDUSTRIAL APPLICABILITY

As made clear in the above description, dielectric resonators, dielectric filters, and dielectric duplexers according to the present invention are able to be applied to the manufacture of a wide variety of electronic equipment, for example, microwave band mobile communication equipment, milliwave band mobile communication equipment, etc.

What is claimed is:

1. A method of manufacturing a dielectric resonator comprising electrodes formed on both the main surfaces of a dielectric substrate, and at least one of the electrodes being made up of a thin film multi-layer electrode comprising thin film conductor layers and thin film dielectric layers having fixed thickness and being alternately laminated, said method comprising the steps of giving abrasive treatment or etching treatment to the external portion of the dielectric substrate and to external portions of the respective electrodes formed on both the main surfaces of the dielectric substrate, including respective end portions of the thin-film conductor layers, such that said end portions of the thin-film conductor layers are made electrically in a condition open-circuited from each other.

2. A method according to claim 1, characterized in that the dielectric substrate constituting the dielectric resonator is in a cylindrical form.

3. A method according to claim 1 or claim 2, characterized in that the respective thickness of each layer of the thin film conductor layers and thin film dielectric layers of the thin film multi-layer electrode formed at least on one main surface of the dielectric substrate is substantially uniform all over the surface on which the thin film multi-layer electrode is formed.

4. A dielectric resonator comprising electrodes formed on both the main surfaces of a dielectric substrate, and at least one of the electrodes being made up of a thin film multi-layer electrode comprising thin film conductor layers and thin film dielectric layers having fixed thickness and being alternately laminated, characterized in that the thin film conductor layers have respective end portions which are electrically in an open-circuited condition from each other, and in that the end portions of the dielectric substrate, the thin film conductor layers, and the thin film dielectric layers are aligned substantially at a common surface;

characterized in that the respective thickness of each layer of the thin film conductor layers and thin film dielectric layers of the thin film multi-layer electrode formed at least on one main surface of the dielectric substrate is substantially uniform all over the surface on which the thin film multi-layer electrode is formed.

5. A dielectric filter comprising a dielectric resonator as claimed in claim 4, further comprising input-output connections coupled to the dielectric resonator.

6. A dielectric resonator as claimed in claim 4, characterized in that the dielectric substrate constituting the dielectric resonator is in a cylindrical form.

7. A dielectric duplexer comprising:

a first group of resonators made up of at least one dielectric resonator comprising electrodes formed on both the main surfaces of a dielectric substrate, and at least one of the electrodes being made up of a thin film multi-layer electrode comprising thin film conductor layers and thin film dielectric layers having fixed thickness and being alternately laminated, characterized in that the thin film conductor layers have respective end portions which are electrically in an open-circuited condition from each other, and in that the end portions of the dielectric substrate, the thin film conductor layers, and the thin film dielectric layers are aligned substantially at a common surface;

a second group of resonators made up of at least one dielectric resonator comprising electrodes formed on both the main surfaces of a dielectric substrate, and at least one of the electrodes being made up of a thin film multi-layer electrode comprising thin film conductor layers and thin film dielectric layers having fixed thickness and being alternately laminated, characterized in that the thin film conductor layers have respective end portions which are electrically in an open-circuited condition from each other, and in that the end portions of the dielectric substrate, the thin film conductor layers, and the thin film dielectric layers are aligned substantially at a common surface;

a first input-output connection and a second input-output connection coupled to the first group of resonators, and a third input-output connection and a fourth input-output connection coupled to the second group of resonators, wherein one of said first and second input-output connections is connected to one of said third and fourth input-output connections.

8. A dielectric duplexer according to claim 7, characterized in that the dielectric substrate constituting each said dielectric resonator is cylindrical in form.

9. A dielectric duplexer according to claim 7 or claim 8, characterized in that in each said dielectric resonator, the respective thickness of each layer of the thin film conductor layers and thin film dielectric layers of the thin film multi-layer electrode formed at least on one main surface of the dielectric substrate is substantially uniform all over the surface on which the thin film multi-layer electrode is formed.

10. A method of making a dielectric resonator, comprising the steps of:

preparing a dielectric substrate with two main surfaces and grinding both of said main surfaces to be flat;

forming a thin film multi-layer electrode comprising thin film conductor layers and thin film dielectric layers having fixed thickness and being alternately laminated on both the main surfaces of the dielectric substrate; and putting respective end portions of the electrodes formed on both the main surfaces of the dielectric substrate in an electrically open-circuited condition by giving abrasive treatment or etching treatment to the external portions of the dielectric substrate and the external portions of the electrodes.

11. A dielectric resonator comprising electrodes formed on both the main surfaces of a dielectric substrate, and at least one of the electrodes being made up of a thin film multi-layer electrode comprising thin film conductor layers and thin film dielectric layers having fixed thickness and being alternately laminated, characterized in that the thin film conductor layers have respective end portions which are electrically in an open-circuited condition from each other, and in that the end portions of the dielectric substrate, the thin film conductor layers, and the thin film dielectric layers are aligned substantially at a common surface; and, further comprising input-output connections coupled to the dielectric resonator.

12. A dielectric resonator as claimed in claim 11, characterized in that the dielectric substrate constituting the dielectric resonator is in a cylindrical form.

* * * * *